US007737534B2

(12) United States Patent
McLaughlin et al.

(10) Patent No.: US 7,737,534 B2
(45) Date of Patent: Jun. 15, 2010

(54) SEMICONDUCTOR DEVICES THAT INCLUDE GERMANIUM NANOFILM LAYER DISPOSED WITHIN OPENINGS OF SILICON DIOXIDE LAYER

(75) Inventors: Sean R. McLaughlin, Severn, MD (US); Narsingh Bahadur Singh, Ellicott City, MD (US); Brian Wagner, Baltimore, MD (US); Andre Berghmans, Owing Mills, MD (US); David J. Knuteson, Ellicott City, MD (US); David Kahler, Arbutus, MD (US); Anthony A. Margarella, Columbia, MD (US)

(73) Assignee: Northrop Grumman Systems Corporation, Los Angeles, CA (US)

( * ) Notice: Subject to any disclaimer, the term of this patent is extended or adjusted under 35 U.S.C. 154(b) by 0 days.

(21) Appl. No.: 12/136,193

(22) Filed: Jun. 10, 2008

(65) Prior Publication Data

US 2009/0302426 A1 Dec. 10, 2009

(51) Int. Cl.
*H01L 29/868* (2006.01)

(52) U.S. Cl. ..... 257/656; 257/E29.085; 257/E29.336; 977/774

(58) Field of Classification Search ..... 257/656, 257/E29.336
See application file for complete search history.

(56) References Cited

U.S. PATENT DOCUMENTS

| | | | | |
|---|---|---|---|---|
| 4,092,210 | A | 5/1978 | Hoepfner | |
| 4,423,127 | A | 12/1983 | Fujimura | |
| 4,476,481 | A | 10/1984 | Iesaka et al. | |
| 4,514,748 | A | 4/1985 | Bean et al. | |
| 4,600,935 | A | 7/1986 | Dresner | |
| 4,604,636 | A | 8/1986 | Dalal | |
| 4,885,622 | A | 12/1989 | Uchiyama et al. | |
| 5,077,875 | A | 1/1992 | Hoke et al. | |
| 5,293,050 | A | 3/1994 | Chapple-Sokol et al. | |
| 5,503,959 | A | 4/1996 | Langston | |
| 5,562,770 | A | 10/1996 | Chen et al. | |
| 5,693,139 | A | 12/1997 | Nishizawa et al. | |
| 5,963,800 | A | 10/1999 | Augusto | |
| 7,008,813 | B1 | 3/2006 | Lee et al. | |
| 7,049,181 | B2 | 5/2006 | Hoag et al. | |
| 7,141,488 | B2 | 11/2006 | Woelk et al. | |
| 7,186,611 | B2 * | 3/2007 | Hsu et al. | 438/237 |
| 7,238,595 | B2 | 7/2007 | Brabant et al. | |
| 7,256,416 | B2 | 8/2007 | Kohda | |
| 7,259,084 | B2 | 8/2007 | Chang et al. | |
| 2004/0197945 | A1 | 10/2004 | Woelk et al. | |
| 2007/0001581 | A1 | 1/2007 | Stasiak et al. | |

(Continued)

*Primary Examiner*—Stephen W Smoot
(74) *Attorney, Agent, or Firm*—Alston & Bird LLP

(57) ABSTRACT

A process is provided for fabricating a semiconductor device having a germanium nanofilm layer that is selectively deposited on a silicon substrate in discrete regions or patterns. A semiconductor device is also provided having a germanium film layer that is disposed in desired regions or having desired patterns that can be prepared in the absence of etching and patterning the germanium film layer. A process is also provided for preparing a semiconductor device having a silicon substrate having one conductivity type and a germanium nanofilm layer of a different conductivity type. Semiconductor devices are provided having selectively grown germanium nanofilm layer, such as diodes including light emitting diodes, photodetectors, and like. The method can also be used to make advanced semiconductor devices such as CMOS devices, MOSFET devices, and the like.

11 Claims, 10 Drawing Sheets

U.S. PATENT DOCUMENTS

2007/0077733 A1 4/2007 Woelk et al.
2007/0099315 A1 * 5/2007 Maa et al. ..... 438/22
2007/0105256 A1 5/2007 Fitzgerald

* cited by examiner

GERMANIUM NANODOT GROWTH ON PATTERNED THERMAL OXIDE
SUBSTRATE: P100 SILICON WAFER WITH 1000Å
THERMAL OXIDE

ASM EPSILON 2000 EPITAXY REACTOR
CVD GROWTH
180 SCCM GERMANE (1% IN $H_2$)
20 TORR REDUCED PRESSURE
20SLM $H_2$ CARRIER GAS
1 MINUTE DEPOSITION AT 650°C
1 MINUTE DEPOSITION AT 925°C

GERMANIUM NANODOT GROWTH- PIN DIODE
SUBSTRATE: PATTERNED P100 SILICON WAFER WITH 1000A
THERMAL OXIDE

SEMICONDUCTOR DEVICES THAT INCLUDE GERMANIUM NANOFILM LAYER DISPOSED WITHIN OPENINGS OF SILICON DIOXIDE LAYER

FIELD OF THE INVENTION

Embodiments of the present invention relate generally to semiconductor devices and their methods of manufacture, and in particular to semiconductor devices having germanium layers incorporated therein.

BACKGROUND OF THE INVENTION

Semiconductor devices are used in wide variety of applications including diodes, photodetector, photocells, transistors, integrated circuits etc. Silicon and germanium are commonly used in such electronic devices. In particular, silicon is the most widely used material in semiconductor devices due to its low cost, relatively simple processing, and useful temperature range. Further, the electronic properties and behavior of silicon and germanium can be relatively easily controlled by the addition of doping elements, for example, in the manufacture of P-I-N and N-I-P diodes.

Recent research has focused on making devices in which a layer of germanium is deposited over the entire surface of a silicon wafer. However, dislocations can occur due to lattice mismatches between the silicon and germanium layers. As a result, the electronic properties of such devices have been less than desired.

BRIEF SUMMARY OF THE INVENTION

In one embodiment, the present invention is directed to a process of fabricating a semiconductor device having a germanium nanofilm layer that is selectively deposited on a silicon substrate in discrete regions or patterns. In particular, this embodiment of the invention provides a semiconductor device having germanium film layer that is disposed in desired regions having a desired patterns that can be prepared in the absence of etching and patterning the germanium film layer. In a further embodiment, the present invention also provides for a process for preparing a semiconductor device having a silicon substrate having one conductivity type and a germanium nanofilm layer of a different conductivity type. This embodiment of the invention also provides for semiconductor devices having selectively grown germanium nanofilm layer, such as diodes including light emitting diodes, photodetectors, and like. Embodiments of the present invention can also be used to make advanced semiconductor devices such as CMOS devices, MOSFET devices, and the like.

In one embodiment, the present invention provides a process of selectively depositing a germanium nanofilm layer on a silicon substrate in which a layer of $SiO_2$ is formed on the substrate followed by etching one or more openings, such as trenches, in the $SiO_2$ layer to expose select regions of the silicon substrate. A germanium nanofilm layer is epitaxially deposited on the exposed regions of the silicon substrate so that at least a portion of the germanium nanofilm layer is in direct physical contact with the silicon substrate.

In one embodiment, the germanium nanofilm layer is formed by depositing a plurality of tightly and closely spaced nanodots on the exposed silicon substrate surface to form a continuous film-like structure.

The germanium nanofilm layer, as well as a layer from which the $SiO_2$ layer is formed, can be deposited utilizing a variety of different techniques including Metal Organic Vapor Phase epitaxy processes (MO-CVD), molecular beam epitaxial processes (MBE) chemical vapor deposition (CVD), physical vapor deposition (PVD) and other thin film deposition processes. The openings in the $SiO_2$ layer can be made using photolithography techniques, such as plasma dry etch or hydrofluoric acid wet etch. As will be appreciated by one of skill in the art, the number of openings, thickness of the openings, and the pattern of the openings can be selected based on the desired semiconductor device and its intended application.

In a further embodiment, the present invention can be used to prepare semiconductor devices in which an intrinsic layer, such as an intrinsic silicon layer or intrinsic germanium layer is disposed between the germanium nanofilm layer and the silicon substrate. For instance, prior to forming the $SiO_2$ layer, an intrinsic silicon layer can be deposited on the surface of the silicon substrate. A portion of the intrinsic silicon layer can then be oxidized to form the $SiO_2$ layer. The $SiO_2$ layer can then be patterned and etched to form one or more openings in which a surface of the intrinsic layer is exposed. The germanium nanofilm layer can then be epitaxially deposited onto the exposed surface of the intrinsic silicon layer.

Other embodiments of the present invention are also directed to semiconductor devices such as P-I-N type or N-I-P type diodes. In one embodiment, the present invention provides a semiconductor device having a silicon substrate of a first conductivity-type; an intrinsic layer formed on the substrate, a silicon dioxide layer formed on an outer portion of the intrinsic layer having one or more openings formed therein in which select portions of the surface of the intrinsic layer are exposed, and a germanium nanofilm layer of a second conductivity type disposed in the openings and in direct physical contact with the intrinsic layer. In some embodiments, metal contact layers may be formed on opposite sides of the semiconductor device. Suitable materials for the contact layers include gold, copper, and aluminum.

In another embodiment, the present invention provides a semiconductor device in which an intrinsic germanium nanofilm layer is deposited in direct physical contact with at least a portion of the surface of the silicon substrate. The surface of the silicon substrate can be exposed by etching one or more openings in an $SiO_2$ layer that is disposed above the intrinsic germanium nanofilm layer. A second silicon layer having a different conductivity than the silicon substrate is then deposited in the opening on at least a portion of the surface of the intrinsic germanium nanofilm layer.

In yet another embodiment, the present invention provides a semiconductor device in which an intrinsic germanium nanofilm layer is deposited in direct physical contact with at least a portion of the surface of silicon substrate and a second germanium nanofilm layer having a different conductivity than the silicon substrate is deposited in the opening on the intrinsic germanium nanofilm layer. The intrinsic silicon layer can be deposited with epitaxy processes as discussed above.

As noted above, embodiments of the present invention provide a method of selectively depositing a nanofilm layer of germanium of a silicon substrate. As a result, the present invention can be used to fabricate a wide variety of different semiconductor devices.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
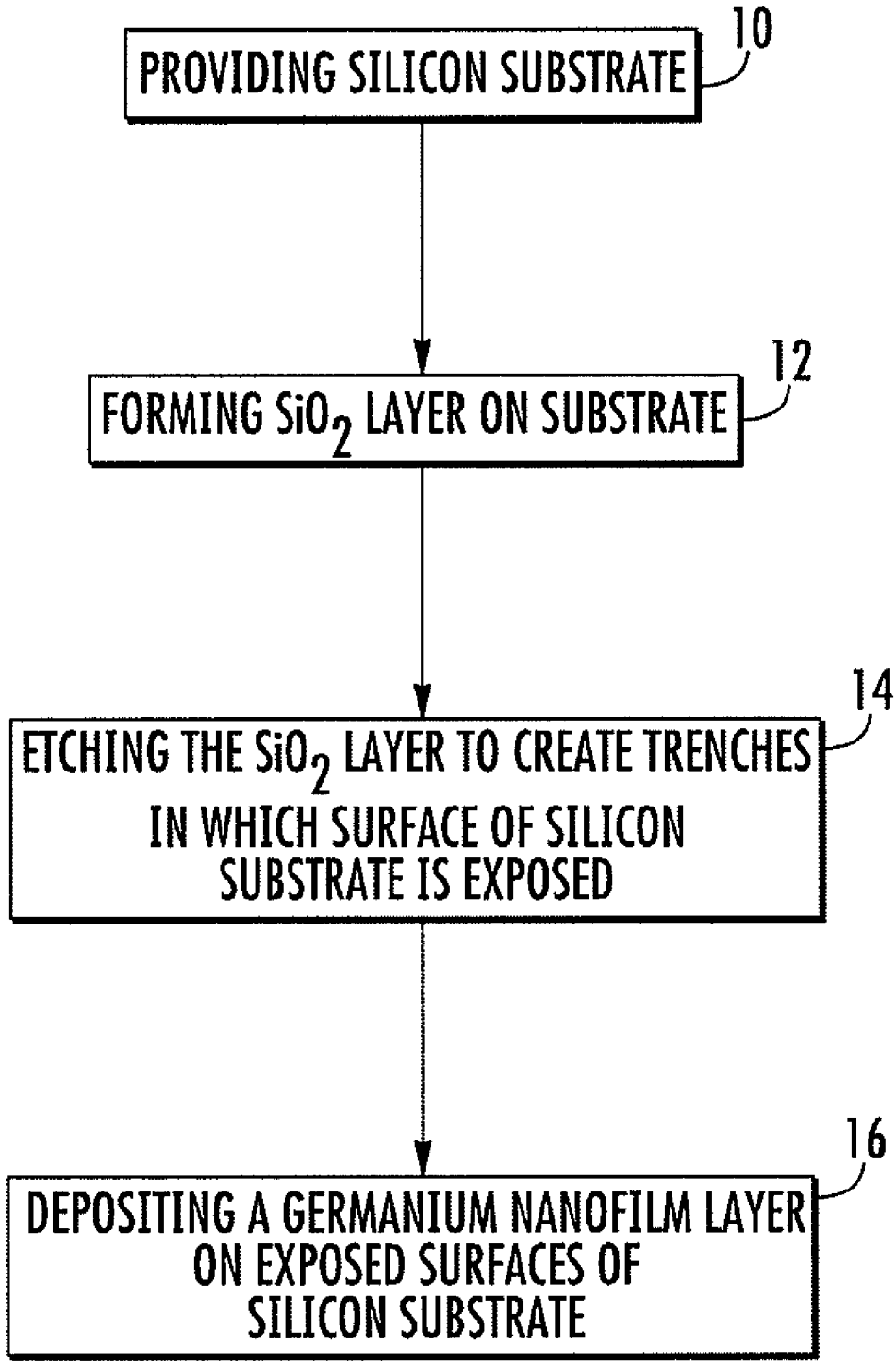
FIG. 1 is a schematic illustration depicting a process of forming a germanium nanofilm layer on a silicon substrate.

With reference to FIG. 1 a process of selectively depositing a germanium nanofilm layer on a silicon substrate is schematically illustrated. In a first step, a silicon substrate is provided. Block 10. A layer of silicon dioxide ($SiO_2$) is then formed on the substrate. Block 12. The $SiO_2$ layer is then etched using photolithography techniques to produce one or more openings in the $SiO_2$ layer to expose select regions of the surface of the silicon substrate. In one embodiment, the openings define openings that extend through the thickness of the $SiO_2$ layer to thereby expose select regions of an underlying layer. Block 14. A germanium nanofilm layer is then epitaxially grown within the openings so that the germanium nanofilm layer is in direct physical contact with the silicon layer. Block 16. In this way, the germanium nanofilm layer is selectively deposited in the openings with little to none of the germanium being deposited on the $SiO_2$ layer. For example, in one embodiment, the germanium nanofilm layer is limited to being present in the one or more openings formed in the $SiO_2$ layer with no germanium being deposited on the surface of the $SiO_2$ layer.

In some embodiments, the germanium nanofilm layer desirably has a thickness ranging from about 10 to 5,000 nanometers (nm), and more desirably from about 100 to 1,000 nm. In one embodiment, the germanium nanofilm layer is formed by depositing a plurality of tightly and closely spaced nanodots on the exposed silicon substrate surface. Ideally, the spacing of the germanium nanodots is such that the nanodots coalesce to have a continuous film-like structure. Typically, the initial deposition of the germanium nanodots is such that the spacing between adjacent dots is no more than 1 nm, and more typically no more than 10 nm. Generally, each nanodot can have a height or thickness of approximately 5 nm-50 nm and a diameter on the order of approximately 5 nm. It should be recognized that the dimensions of the nanodots can be adapted in accordance with the requirements of the particular application and device being fabricated. For example, wavelength of emission can be matched to a waveguide and/or detector for optical signal transmission.

Generally, the germanium nanodoats can be deposited at temperatures ranging from about 450° C. to 1000° C., and at pressures from about 10 to 760 Torr, with a pressure of about 20 Torr being somewhat preferred. In one embodiment, the deposition of the germanium nanodots is carried out a temperature from about 450 to 930° C. and at a pressure from about 10 to 60 torr.

It is believed that the coalescing of the germanium nanodots is due to high energy surfaces, especially surfaces which have been etched. As the nanodots initially grow, the nanodots tend to initiate at these high energy surfaces as oppose to low energy surfaces, such as unetched silicon. As the nanodots continue to grow, in close proximity to each other, the nanodots touch and fuse by overcoming the lattice mismatch between germanium and silicon. It is believed that the lattice mismatch between germanium and silicon is a significant factor in the initial growth of germanium as a nanodot.

As discussed in greater detail below, the germanium nanofilm layer, as well as a layer from which the $SiO_2$ layer is formed, can be deposited utilizing a variety of different techniques including Metal Organic Vapor Phase epitaxy processes (MO-CVD), molecular beam epitaxial processes (MBE) chemical vapor deposition (CVD), physical vapor deposition (PVD) and other thin film deposition processes.

The openings in the $SiO_2$ layer can be made using photolithography techniques, such as plasma dry etch or hydrofluoric acid wet etch. As will be appreciated by one of skill in the art, the number of openings, thickness of the openings, and the pattern of the openings can be selected based on the desired semiconductor device and its intended application. For example, the $SiO_2$ layer can be etched to have a desired pattern so that the resulting germanium nanofilm layer also has a desired pattern. As a result, semiconductor devices can be fabricated having a germanium nanofilm layer with a desired pattern without the need to pattern and etch a germanium film layer.

In a further embodiment, the present invention can be used to prepare semiconductor devices in which an intrinsic layer, such as an intrinsic silicon layer or intrinsic germanium layer is disposed between the germanium nanofilm layer and the silicon substrate. For instance, prior to forming the $SiO_2$ layer, an intrinsic silicon layer can be deposited on the surface of the silicon substrate. The intrinsic silicon layer can be deposited with epitaxy processes as discussed above. In a subsequent step, a portion of the intrinsic silicon layer can be oxidized to form the $SiO_2$ layer. The $SiO_2$ layer can then be patterned and etched to form one or more openings in which a surface of the intrinsic layer is exposed. The germanium nanofilm layer can then be epitaxially deposited onto the exposed surface of the intrinsic silicon layer. As discussed in greater detail below, this embodiment of the present invention can be used to fabricate P-I-N type or N-I-P type diodes, among other types of semiconductor devices.

For example, in one embodiment a semiconductor device can be fabricated in which the silicon substrate has a P-type conductivity, such as P, P+, P++, etc., and the germanium nanofilm layer has a N-type conductivity, such as N, N +, N ++, etc. Alternatively, the silicon substrate can have an N-type conductivity, such as, N, N +, N ++ etc., and the germanium nanofilm layer can have a P-type conductivity, such as P, P+, P++, etc. Exemplary N-type doping materials include phosphorus, arsenic, and antimony. Exemplary P-type doping materials include boron and aluminum. The silicon layer and the germanium nanofilm layer can be doped with N- or P-type material using methods known in the art.

Figure 2:
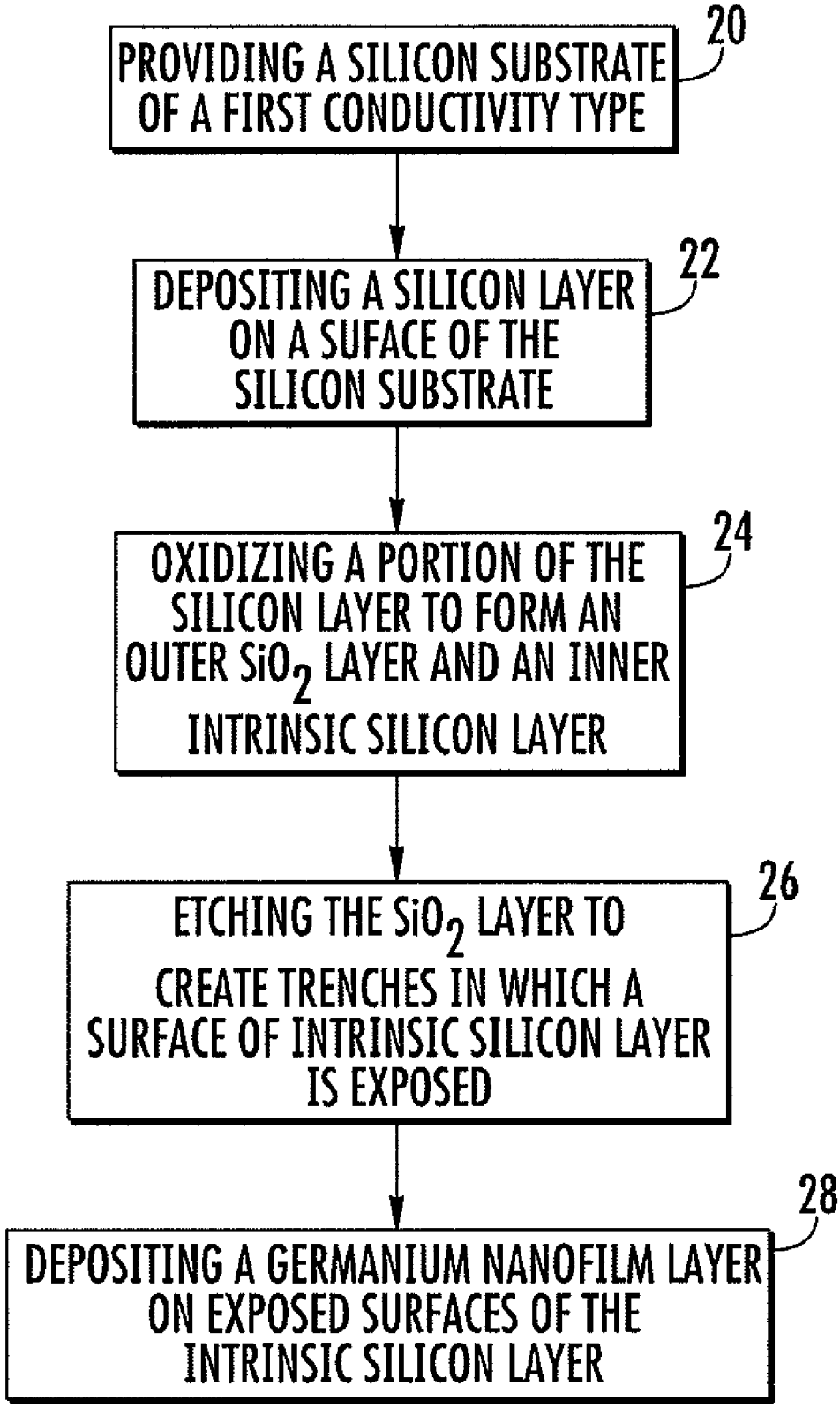
FIG. 2 is a schematic illustration depicting a process of forming a semiconductor device having a silicon substrate of a first conductivity type and a germanium nanofilm layer of a second conductivity type selectively deposited on an intrinsic silicon layer.

With reference to FIG. 2 a process of preparing a semiconductor device in accordance with one embodiment of the present invention is schematically illustrated. In a first step, a silicon substrate of a first conductivity is provided. Block 20. Next, a layer of silicon is deposited onto the surface of the silicon substrate. Block 22. An outer portion of the silicon layer is then oxidized to form a $SiO_2$ layer and an intrinsic silicon layer on the silicon substrate. Block 24. The intrinsic silicon layer is disposed between the silicon substrate and the outer $SiO_2$ layer. The $SiO_2$ layer is then etched using photolithography techniques to produce one or more openings in the $SiO_2$ layer to expose select regions of the surface of the intrinsic silicon layer. Block 26. A germanium nanofilm layer of a second conductivity type is then epitaxially grown within the openings so that the germanium nanofilm layer is in direct physical contact with the intrinsic silicon layer. Block 28.

Generally, each layer of the semiconductor device (e.g., $SiO_2$ layer, intrinsic silicon layer, germanium nanofilm layer, etc.) is disposed on a preceding layer so that the layers are positionally on or over another layer regardless of whether there are any intervening layers. For example, if one layer is positioned on another layer, this does not necessarily mean that the two layers are in physical contact with each other.

Figure 3:
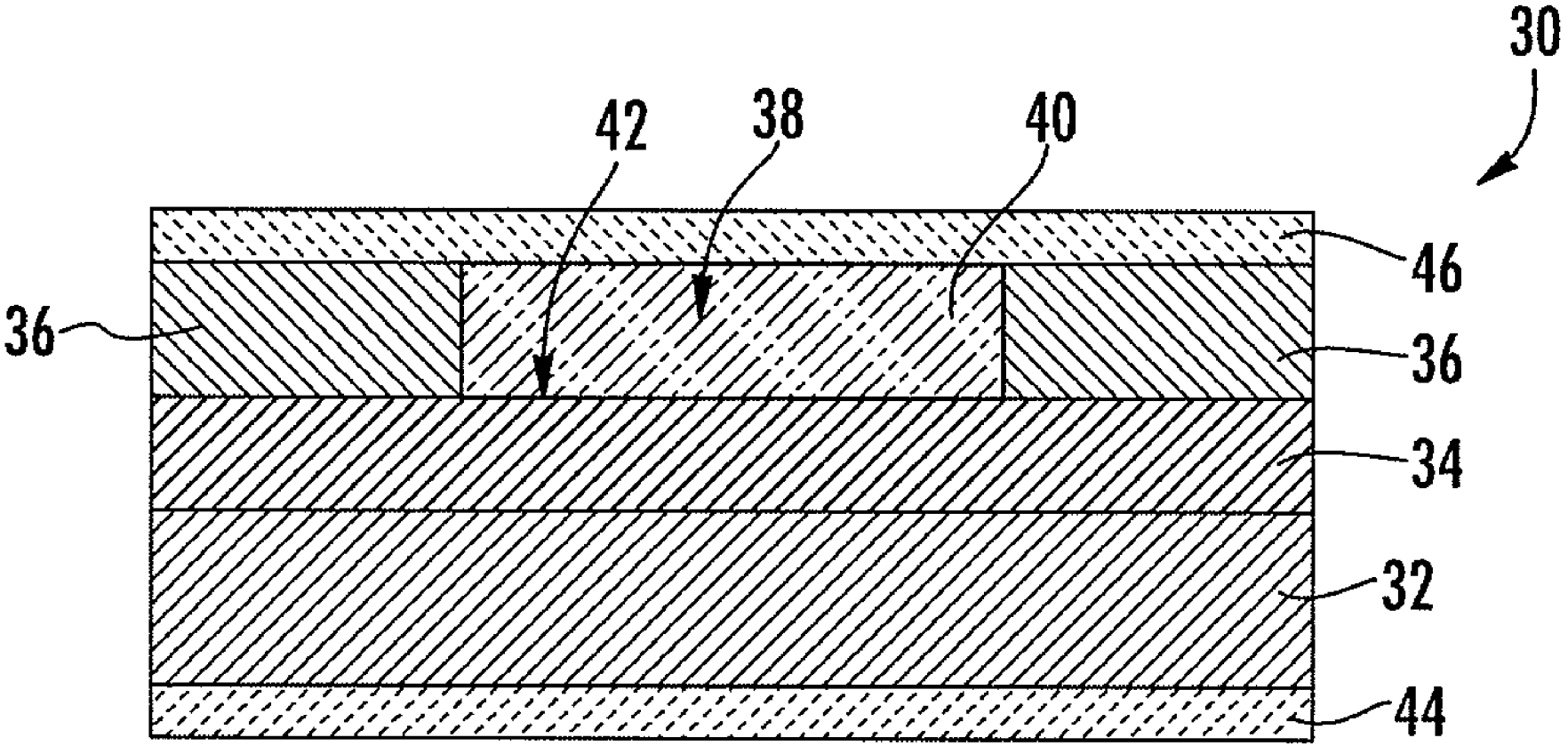
FIG. 3 is a cross-section of a semiconductor device having a silicon substrate of a first conductivity type and germanium nanofilm layer of a second conductivity type that is selectively deposited on a surface of an intrinsic silicon layer in openings formed in an $SiO_2$ layer.
Figure 4:
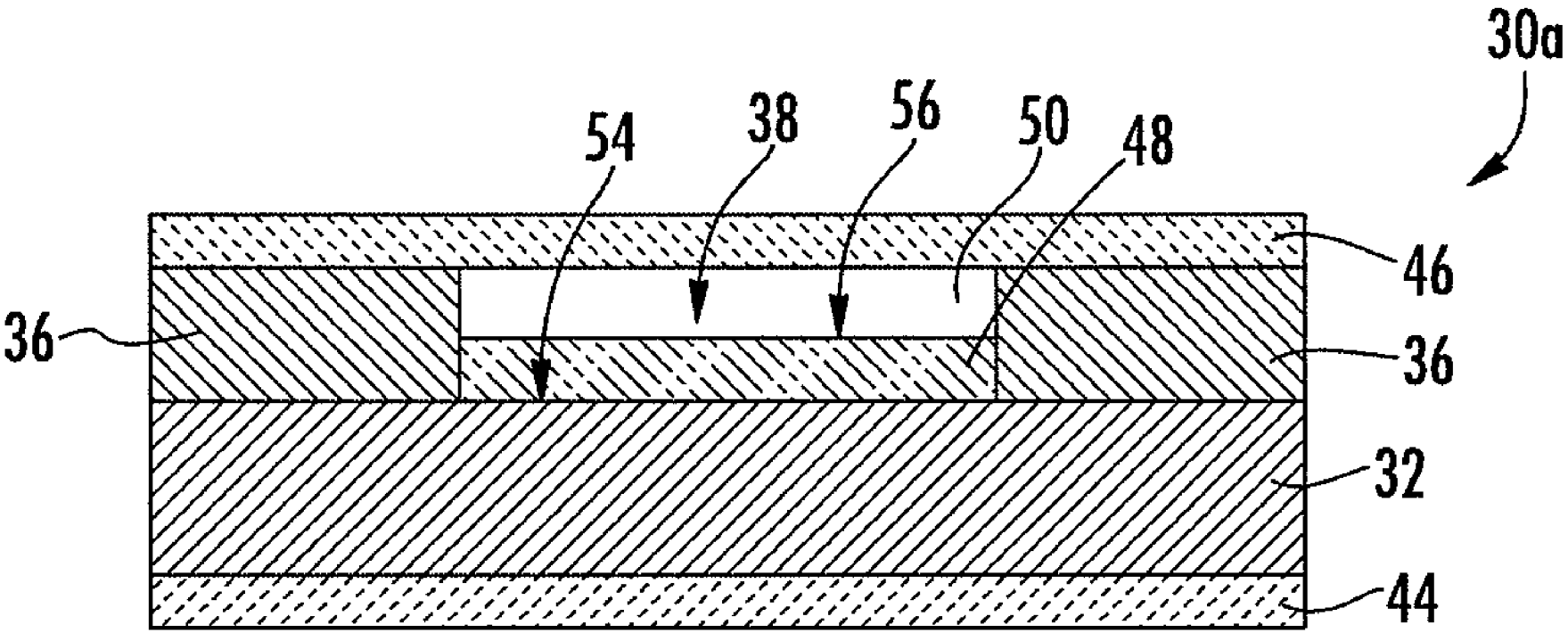
FIG. 4 is a cross-section of a semiconductor device having a silicon substrate of a first conductivity type and a silicon layer of a second conductivity type, wherein the silicon layer is deposited on an intrinsic germanium nanofilm layer that is selectively deposited on a surface of silicon substrate in openings formed in an $SiO_2$ layer.
Figure 5:
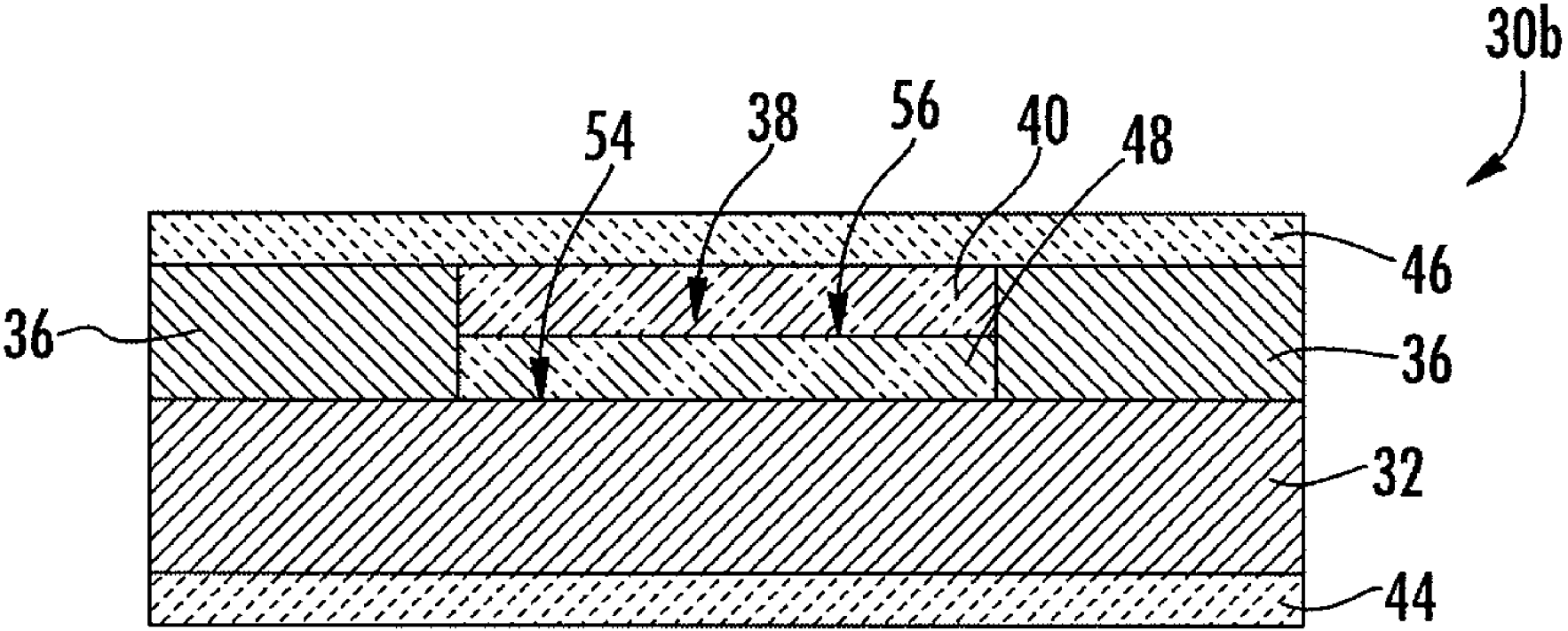
FIG. 5 is a cross-section of a semiconductor device having a silicon substrate of a first conductivity type, a germanium nanofilm layer of a second conductivity type, and an intrinsic germanium nanofilm layer wherein germanium nanofilm layers are selectively deposited formed in an $SiO_2$ layer.

With reference to FIGS. 3-5, exemplary semiconductor devices that are in accordance with embodiments of the present invention are illustrated. In the illustrated embodiments, the semiconductor devices comprise diodes of the P-I-N type. It should be understood that an N-I-P device can also be fabricated and operate in accordance with the present invention. Selection of device type depends on the particular application in which the device is being used. Turning to FIG. 3, a semiconductor device 30 is illustrated in which the device includes a silicon substrate 32 of a first conductivity-type; an intrinsic layer 34, a silicon dioxide layer 36 having one or more openings 38 formed therein, and a germanium nanofilm layer 40 of a second conductivity type disposed in the openings and in direct physical contact with the surface 42 intrinsic layer.

In this embodiment, a silicon substrate 32 that has been doped with either a P- or N-type semiconductor material is provided. An intrinsic silicon layer 34 is then deposited on the silicon substrate 32 using MOCVD epitaxy. Generally, the thickness of the intrinsic silicon layer 34 can range from between about 20 to 400 nm. For example, the intrinsic silicon layer can have a thickness from about 20 to 100 nm. An outer portion of the intrinsic silicon layer 34 is oxidized to form $SiO_2$ layer 36. The intrinsic silicon layer can be oxidized, for example, using a dry oxygen or wet oxygen environment under high temperature to grow the $SiO_2$ layer. Typically, the oxidation of the intrinsic silicon layer is carried out at a temperature from about 800 to 1,200 C, and more typically from about 850 to 1,000 C. In the illustrated embodiment, the thickness of the $SiO_2$ layer can be selected based on a desired and/or expected thickness of the germanium nanofilm layer 40. Typically, the thickness of the $SiO_2$ layer is between about 10 to 100 nm, and more typically between about 50 and 100 nm.

After the $SiO_2$ layer has been formed, a photolithography mask can be used to pattern and etch the $SiO_2$ layer to form one or more openings in the $SiO_2$ layer. The $SiO_2$ layer is desirably etched to expose at least a portion of the surface of the intrinsic silicon layer. The germanium nanofilm layer 40 is then grown in the openings using a deposition process, such as MOCVD. As discussed above, the germanium nanofilm layer is created in the opening(s) by depositing a plurality of tightly packed nanodots that coalesce to create a continuous germanium nanofilm layer in each of the openings. The germanium nanofilm layer is desirably a different conductivity type than the silicon substrate.

In some embodiments, metal contact layers 44, 46 are formed on opposite sides of the semiconductor device 30. Suitable materials for the contact layers include gold, copper, and aluminum. The contact layers can be formed using deposition processes discussed above, such as PVD (physical vapor deposition). The thickness of the contact layers generally ranges between about 50 to 5,000 nm. Typically metal evaporation, such as e-beam or resistance heated, can also be used to form the contact layers.

FIG. 4 illustrates an embodiment of a semiconductor device 30*a* in which an intrinsic germanium nanofilm layer 48 is deposited in direct physical contact with at least a portion of the surface 54 of the silicon substrate 32. The surface 54 of the silicon substrate 32 is exposed by etching one or more openings in the $SiO_2$ layer 36 as discussed above. A second silicon layer 50 having a different conductivity than the silicon substrate is then deposited in the opening on at least a portion of the surface 56 of the intrinsic germanium nanofilm layer 48. For example, the silicon substrate 32 can have a conductivity of the P-type whereas the second silicon layer 50 has a conductivity of the N-type, and vice versa.

As shown in FIG. 4, the $SiO_2$ layer 36 can be formed directly on the surface 54 of the silicon substrate, and can then be etched to expose a portion of the surface 54 of the silicon substrate. The intrinsic germanium nanofilm layer 48 is then deposited within the opening 38 in direct physical contact with the thus exposed surface 54 of the silicon substrate. Generally, the intrinsic germanium nanofilm layer has a thickness between about 5 to 50 nm, and more typically between about 10 to 30 nm, and the second silicon layer 50 has a thickness between about 10 to 100 nm, and more typically between about 25 to 75 nm. Typically, the thickness of the intrinsic germanium nanofilm layer 50 is between about 10 to 50% of the total depth of the opening. Contacts 44, 46 can then be formed on opposite sides of the semiconductor device 20*a* as discussed above.

In one embodiment, the present invention provides a semiconductor device having an intrinsic silicon layer with a thickness that ranges from about 10 to 100 nm, and a germanium nanofilm layer having a thickness ranging from about 25 to 250 nm.

FIG. 5 illustrates a further embodiment of a semiconductor device 30*b* in which an intrinsic germanium nanofilm layer 48 is deposited in direct physical contact with at least a portion of the surface 54 of silicon substrate 32. A second germanium nanofilm layer 40 having a different conductivity than the silicon substrate 32 is deposited in the opening on the intrinsic germanium nanofilm layer. For example, the silicon substrate 32 can have a conductivity of the P-type whereas the second germanium nanofilm layer 40 has a conductivity of the N-type, and vice versa.

As shown in FIG. 5, the $SiO_2$ layer 36 can be formed directly on the surface 54 of the silicon substrate, and can then be etched to expose a portion of the surface of the silicon substrate. The intrinsic germanium nanofilm layer can then be deposited within the opening in direct physical contact with the thus exposed surface of the silicon substrate as discussed above in connection with FIG. 4. The second germanium nanofilm layer is then deposited in the opening 38 on the surface 56 of the intrinsic germanium nanofilm layer as discussed above. Contacts 44, 46 can then be formed on opposite sides of the semiconductor device 30*b*. The thicknesses of each respective layer are generally in accordance with the embodiment discussed above in connection with FIG. 3.

As briefly noted above, embodiments of the present invention can be used to fabricate a wide variety of semiconductor devices including P-I-N diodes and N-I-P diodes, as well as advanced semiconductor devices such as CMOS and MOSFET devices.

EXAMPLE 1

Figure 6:
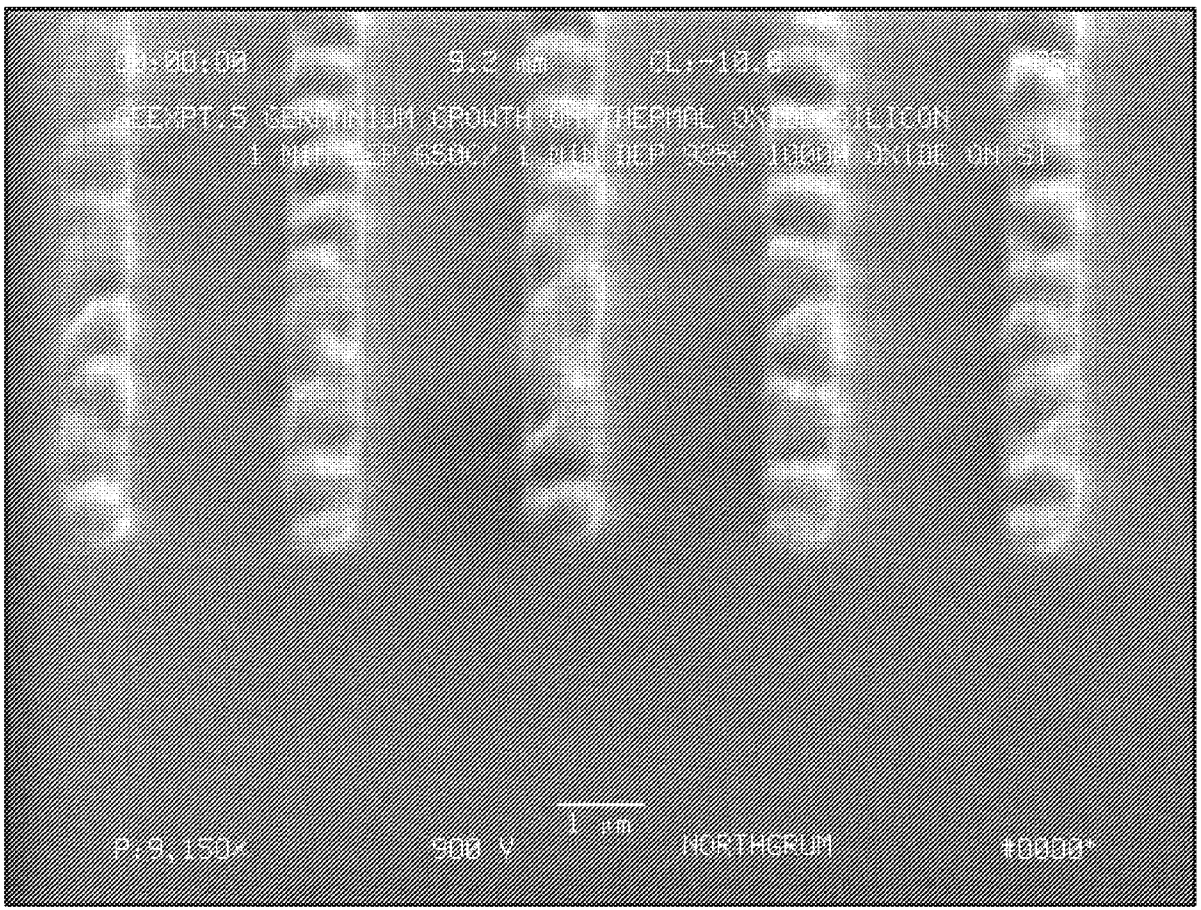
FIG. 6 is an SEM image of a silicon substrate having an outer $SiO_2$ layer with openings formed therein and in which a nanofilm layer of germanium has selectively been deposited in the openings on the surface of the silicon substrate.

A silicon substrate measuring 150 mm in diameter and having a major surface in the (100) plane was utilized. A 100 nm thermal silicon oxide layer was patterned and etched to expose select regions of the surface of the silicon substrate. A germanium nanofilm layer was then epitaxially grown in the openings on the exposed surfaces of the silicon substrate. An ASM Epsilon 2000 Epitaxy Reactor was used to chemically vapor deposit the germanium nanofilm layer within the openings. The initial deposition was carried out at a temperature of 650° C. for one minute. A germanium nanofilm layer was grown using 180 sccm Germane gas (1% in $H_2$ carrier gas) at a reduced pressure of 20 torr. 20 SLM $H_2$ was used as the carrier gas. This first deposition was followed by a second deposition for an additional minute with a reactor temperature of 925° C. FIG. 6 is an SEM image at 9,150 times magnification of the surface of the silicon substrate that shows the selective deposition of the germanium nanofilm layer in the etched openings. No germanium is detectable on the surface of the $SiO_2$ layer.

The $SiO_2$ was etched using a dry etch plasma utilizing a photolithography mask to define the openings. After etching, the photoresist was removed by ashing the photoresist. Prior to germanium growth, the wafer was dipped in dilute Hydrofluoric acid to remove native oxide growth (~75 A of $SiO_2$ is removed). A hydrogen terminated silicon surface was the starting point for germanium growth.

EXAMPLE 2

Figure 7:
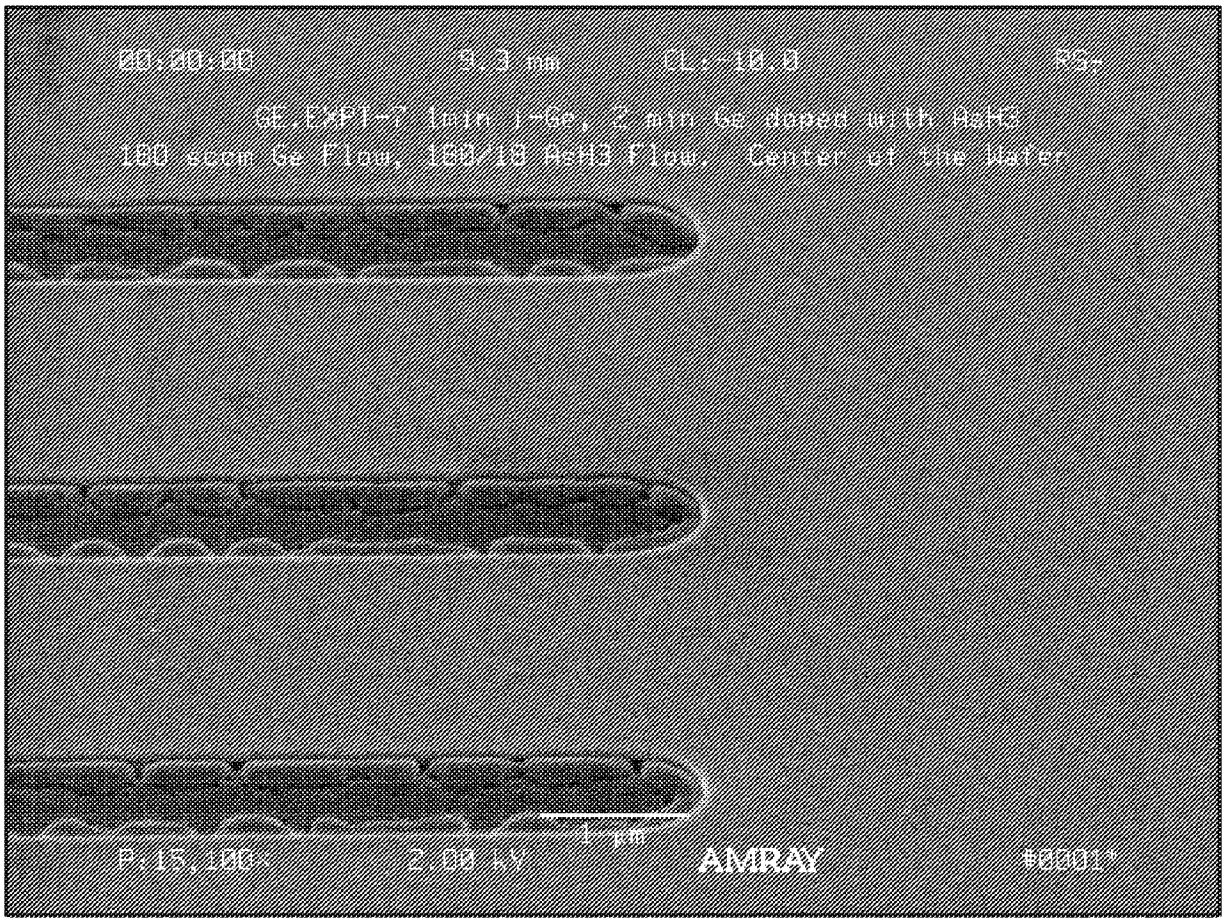
FIG. 7 is an SEM image of PIN diode that has been fabricated in accordance with the invention.
Figure 8:
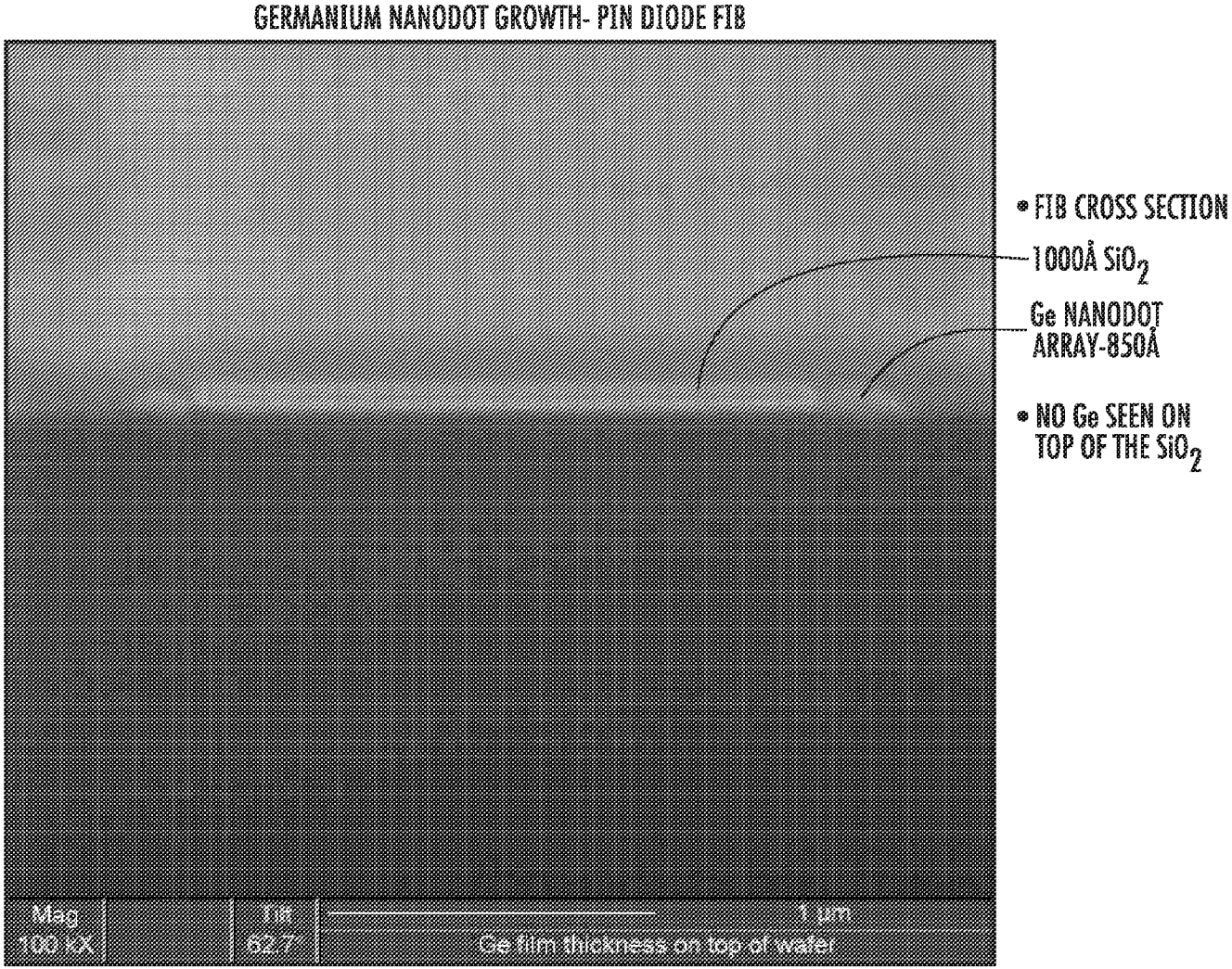
FIG. 8 is a cross-sectional FIB image of the PIN diode of FIG. 7.

In this example, a PIN diode was formed having an intrinsic germanium nanofilm layer. A silicon substrate measuring 150 mm in diameter and having a major surface in the (100) plane was utilized. A 100 nm thermal silicon oxide layer was patterned and etched to expose select regions of the surface of the silicon substrate. An intrinsic germanium nanofilm layer was then epitaxially grown in the openings on the exposed surfaces of the silicon substrate. An ASM Epsilon 2000 Epitaxy Reactor was used to chemically vapor deposit the germanium nanofilm layer within the openings. The reactor temperature was at 650° C. The intrinsic germanium nanofilm layer was grown using 180 sccm Germane gas (1% in $H_2$ carrier gas) for 1 minute deposition at a pressure of 20 torr. Next, an N-doped layer of germanium was deposited in the openings on the surface of the intrinsic germanium nanofilm layer. The deposition was performed for 2 minutes at a reactor temperature of 650° C. 55 ppm Arsine in hydrogen was used as the dopant gas. FIG. 7 is an SEM image at 15,100× magnification of the resulting PIN diode that shows selective deposition of the intrinsic germanium nanofilm layer and the N-doped germanium nanofilm layer within the etched openings. FIG. 7 depicts the Intrinsic and N-region selectively deposited in the oxide openings. The SEM shows a film in the middle of the openings with more coalesced nanodots on the edges of the oxide openings. FIG. 8 is a focused ion beam (FIB) cross-sectional image of the PIN diode that was taken with at 100,000×. FIG. 8 shows that the thickness of the germanium nanofilm was about 85 nm. No germanium can be seen on the surface of the $SiO_2$ layer.

Figure 9:
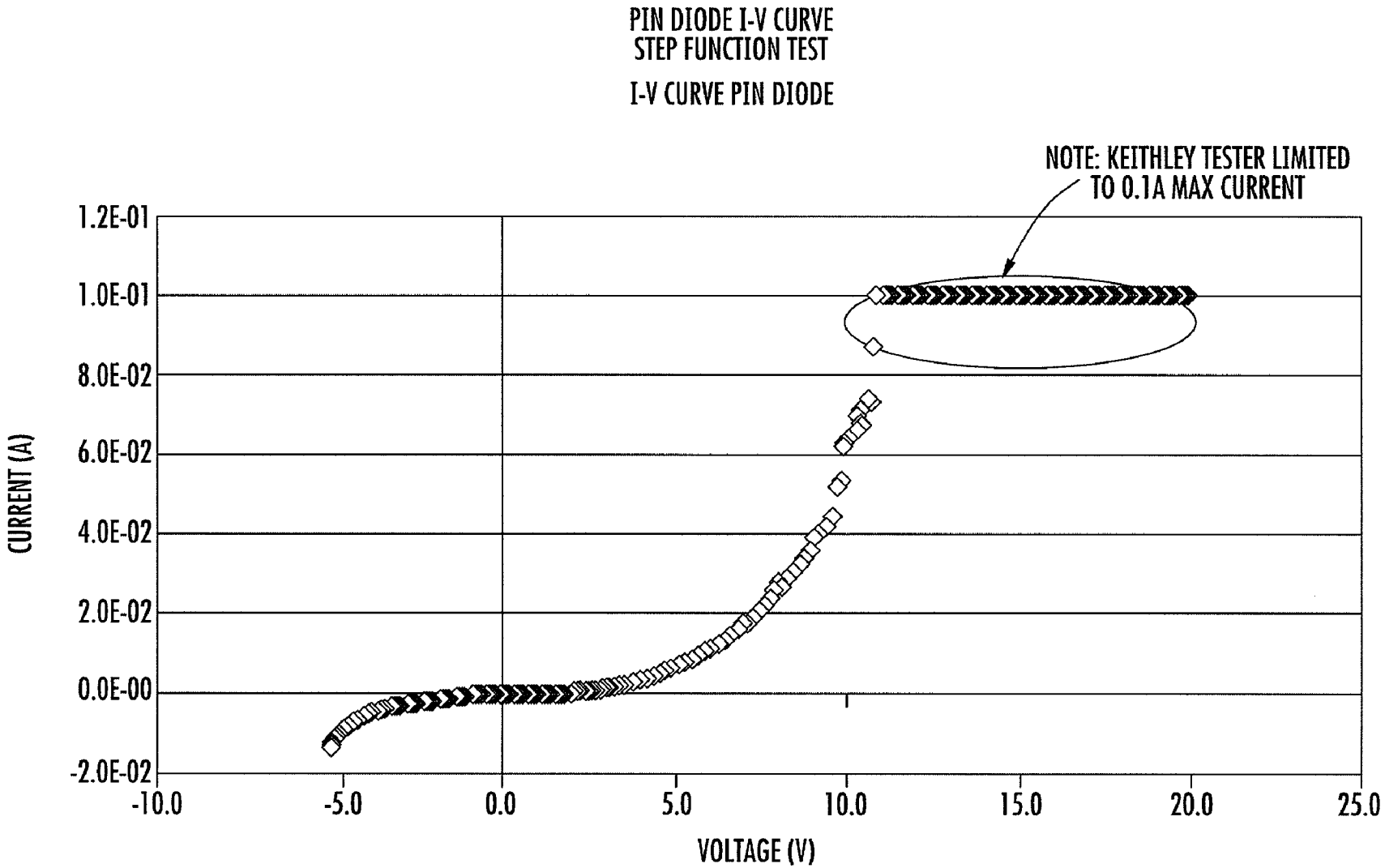
FIG. 9 is a I-V curve for a P-I-N diode that is in accordance with one embodiment of the invention.
Figure 10:
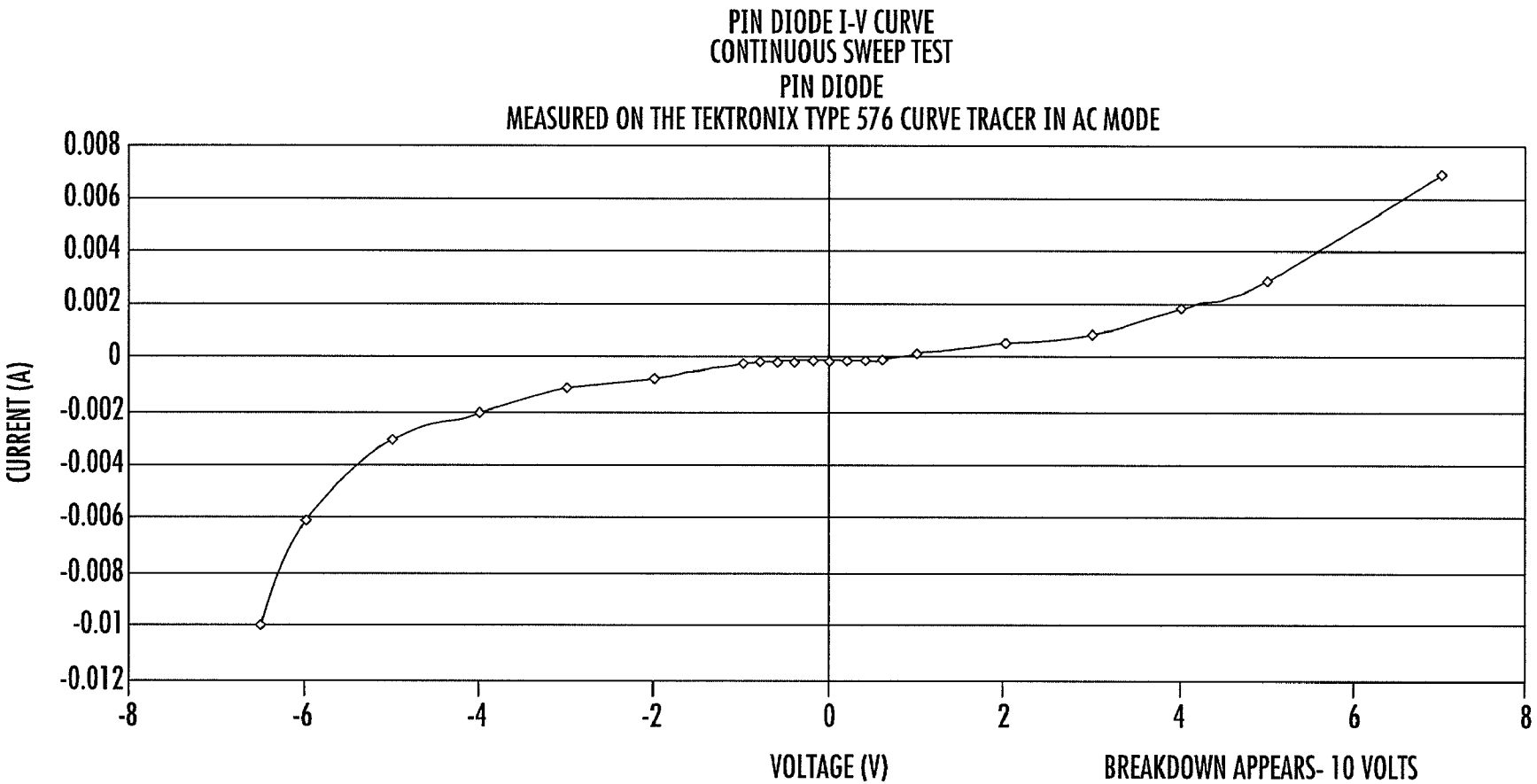
FIG. 10 is a I-V curve continuous sweep test for a P-I-N diode that is in accordance with one embodiment of the invention.

FIGS. 9 and 10 are IV curves of the PIN device fabricated on P+ Silicon. An intrinsic layer of germanium was first selectively deposited on the Silicon and a subsequent N+ doped germanium film was deposited on top of the i-Ge. FIG. 9 is a forward sweep from −5 volts to +20 volts on the PIN device. Turn on voltage was around 5 volts. At approximately 11 volts the current was above the tester's current limit.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a germaniumneric and descriptive sense only and not for purposes of limitation.

That which is claimed:

1. A semiconductor device comprising:

a silicon layer of a first conductivity-type;

an intrinsic layer comprising silicon disposed on said silicon layer;

an $SiO_2$ layer having one or more openings formed therein; and a germanium nanofilm layer of a second conductivity-type disposed in said openings and in direct physical contact with said intrinsic layer.

2. The semiconductor device of claim 1, wherein the germanium nanofilm layer has a thickness of between 100 to 1,000 nm.

3. The semiconductor device of claim 1, wherein the presence of the germanium nanoflim is substantially limited to being present in the one or more openings formed in the $SiO_2$ layer.

4. The semiconductor device of claim 1, wherein the semiconductor device comprises a PIN or NIP diode.

5. A semiconductor device comprising:

a silicon substrate of a first conductivity-type;

an intrinsic silicon layer disposed on said substrate;

an $SiO_2$ layer disposed on the intrinsic silicon layer and having one or more openings formed therein in which the surface of the intrinsic silicon layer is exposed; and a germanium nanofilm layer of a second conductivity-type disposed in said openings and in direct physical contact with said exposed regions of the intrinsic silicon layer.

6. The semiconductor device of claim 5, wherein in the germanium nanofilm layer comprises a plurality of tightly spaced germanium nanodots.

7. The semiconductor device of claim 5, wherein intrinsic silicon layer has a thickness that ranges from about 10 to 100 nm, and the germanium nanofilm layer has a thickness ranging from about 25 to 250 nm.

8. The semiconductor device of claim 5, further comprising a metal layer disposed on a surface of the silicon substrate that is opposite the intrinsic silicon layer, and a second metal layer disposed at least partially on the surface of the germanium nanofilm layer.

9. A semiconductor device comprising:

a silicon substrate of a first conductivity-type;

an $SiO_2$ layer disposed on the silicon substrate and having one or more openings formed therein so that a surface of silicon substrate is exposed, wherein said one or more openings have a first depth;

an intrinsic germanium nanofilm layer disposed in said openings and in direct physical contact with said exposed regions of the silicon substrate so that at least a portion of the germanium nanofilm layer is in direct physical contact with said silicon substrate; and a silicon layer of a second conductivity type disposed in said one or more openings so that the intrinsic germanium nanofilm layer is disposed between the silicon substrate and the silicon layer.

10. The semiconductor device of claim 9, wherein the semiconductor device is a PIN diode.

11. The semiconductor device of claim 9, wherein the semiconductor device is a NIP diode.

* * * * *

UNITED STATES PATENT AND TRADEMARK OFFICE

CERTIFICATE OF CORRECTION

PATENT NO. : 7,737,534 B2
APPLICATION NO. : 12/136193
DATED : June 15, 2010
INVENTOR(S) : McLaughlin et al.

It is certified that error appears in the above-identified patent and that said Letters Patent is hereby corrected as shown below:

Column 8,

Line 60, “nanoflim” should read --nanofilm--.

Signed and Sealed this
Thirtieth Day of August, 2011

David J. Kappos

David J. Kappos
*Director of the United States Patent and Trademark Office*